US006768503B1

(12) United States Patent
Shih et al.

(10) Patent No.: US 6,768,503 B1
(45) Date of Patent: Jul. 27, 2004

(54) PREVENTING CREASE FORMATION IN DONOR WEB IN DYE TRANSFER PRINTER THAT CAN CAUSE LINE ARTIFACT ON PRINT

(75) Inventors: Po-Jen Shih, Webster, NY (US); Zhanjun J. Gao, Rochester, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/426,591

(22) Filed: Apr. 30, 2003

(51) Int. Cl.[7] ..... B41J 11/057; B41J 35/04; B41J 35/08

(52) U.S. Cl. ..... 347/216; 400/234; 400/247; 400/248

(58) Field of Search ..... 347/216; 400/247, 400/248, 234

(56) References Cited

FOREIGN PATENT DOCUMENTS

| | | | | |
|---|---|---|---|---|
| JP | 59-68282 | * | 4/1984 | ..... B41J/17/30 |
| JP | 60-157889 | * | 8/1985 | ..... 400/234 |
| JP | 07-178993 | * | 7/1995 | ..... B41J/17/30 |

* cited by examiner

*Primary Examiner*—Huan Tran
(74) *Attorney, Agent, or Firm*—Roger A. Fields; Mark G. Bocchetti

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

19 Claims, 11 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATIONS

Cross-reference is made to commonly assigned, co-pending application Ser. No. 10/394,888, entitled PREVENTING CREASE FORMATION IN DONOR WEB IN DYE TRANSFER PRINTER THAT CAN CAUSE LINE ARTIFACT ON PRINT, and filed Mar. 21, 2003 in the names of Zhanjun J. Gao, Robert F. Mindler and Po-Jen Shih, and Ser. No. 10/392,502, entitled PREVENTING CREASE FORMATION IN DONOR WEB IN DYE TRANSFER PRINTER THAT CAN CAUSE LINE ARTIFACT ON PRINT, and filed Mar. 20, 2003 in the names of Zhanjun J. Gao, John F. Corman and Robert F. Mindler.

FIELD OF THE INVENTION

The invention relates generally to dye transfer or thermal printers, and in particular to the problem of crease or wrinkle formation in successive dye transfer areas of a dye donor web. Crease formation in the dye transfer area can result in an undesirable line artifact being printed on a dye receiver.

BACKGROUND OF THE INVENTION

A typical multi-color dye donor web that is used in a dye transfer or thermal printer is substantially thin and has a repeating series of three different rectangular-shaped color sections or patches such as a yellow color section, a magenta color section and a cyan color section. Also, there may be a transparent colorless laminating section immediately after the cyan color section.

Each color section of the dye donor web consists of a dye transfer area that is used for dye transfer printing and a pair of opposite longitudinal edge areas alongside the dye transfer area which are not used for printing. The dye transfer area is about 152 mm wide and the two edge areas are each about 5.5 mm wide, so that the total web width is approximately 163 mm.

To make a multi-color image print using a thermal printer, a motorized donor web take-up spool pulls the dye donor web from a donor web supply spool in order to successively draw an unused single series of yellow, magenta and cyan color sections over a stationary bead of selectively heated resistive elements on a thermal print head between the two spools. Respective color dyes within the yellow, magenta and cyan color sections are successively heat-transferred, via the bead of selectively heated resistive elements, in superimposed relation onto a dye receiver medium such as a paper or transparency sheet or roll, to form the color image print. The bead of resistive elements often extends across the entire width of a color section, i.e. across its dye transfer area and the two edge areas alongside the dye transfer area. However, in this instance, only those resistive elements that contact the dye transfer area are selectively heated. Those resistive elements that contact the two edge areas are not heated. In other words, the dye transfer is effected from the dye transfer area to the dye receiver medium, but not from the two edge areas to the dye receiver medium.

As each color section, including its dye transfer area and the two edge areas alongside the dye transfer area, is drawn over the bead of selectively heated resistive elements, the color section is subjected to a longitudinal tension particularly by a forward pulling force of the motorized donor web take-up spool. Since the dye transfer area is heated by the resistive elements, but the two edge areas alongside the dye transfer area are not, the dye transfer area is significantly weakened and therefore vulnerable to stretching as compared to the two edge areas. Consequently, the longitudinal tension will stretch the dye transfer area relative to the two edge areas. This stretching causes the dye transfer area to become thinner than the non-stretched edge areas, which in turn causes some creases or wrinkles to develop in the dye transfer area, mostly in those regions of the dye transfer area that are close to the two edge areas. The creases or wrinkles occur mostly in the regions of the dye transfer area that are close to the two edge areas because of the sharp, i.e. abrupt, transition between the weakened transfer area and the stronger edge areas. Moreover, they tend to be slanted diagonally across such regions of the dye transfer area.

As the dye donor web is pulled by the motorized donor web take-up spool over the bead of selectively heated resistive elements, the creases or wrinkles tend to spread from a trailing or rear end portion of a used dye transfer area at least to a leading or front end portion of the next dye transfer area to be used. A problem that can result is that the creases or wrinkles in the leading or front end portion of the next dye transfer area to be used will cause undesirable line artifacts to be printed on a leading or front end portion of the dye receiver medium, when the dye transfer occurs at the creases in the leading end portion of the next dye transfer area to be used. The line artifacts printed on the dye receiver medium are relatively short, but quite visible.

The question presented therefore is how to solve the problem of the creases or wrinkles being created in an unused transfer area so that no line artifacts are printed on the dye receiver medium during the dye transfer.

The Cross-Referenced Applications

The cross-referenced applications disclose a thermal printer capable of preventing slanted crease formation in a dye transfer area of a dye donor web that can cause line artifacts to be printed on a dye receiver during a dye transfer from the dye transfer area to the dye receiver.

To prevent slanted crease formation, cross-referenced application Ser. No. 10/392,502 discloses a pair of conical-shaped web-spreading rollers positioned to extend diagonally across at least the regions of the dye transfer area in which there can be slanted crease formation. The web-spreading rollers oppose any crease formation in such regions by urging the regions to spread.

On the other hand, cross-referenced application Ser. No. 10/394,888 discloses a single web-spreading roller on which fibers are diagonally wound approximately 45° inwardly towards one another from coaxial opposite ends of the roller. The diagonal fibers spread the regions of the dye transfer area in which there can be slanted crease formation, to oppose such crease formation.

SUMMARY OF THE INVENTION

A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a donor web take-up that exerts a pulling force on the dye transfer area and two edge areas at the print head which longitudinally tensions the dye transfer area and two edge areas, to tend to cause the dye transfer area to stretch relative to the two edge areas, to possibly form slanted creases extending at least across respective regions of the dye transfer area adjacent the two edge areas; and a crease-preventing web roller having respective helical grooves spiraled inwardly from coaxial opposite ends of the roller to form resilient helical ribs that, when deformed towards the opposite ends because of the longitudinal tensioning of the dye transfer area and two edge areas, cause at least the regions of the dye transfer area in which the slanted creases can form to spread in opposition to crease formation, so that line artifacts will not be printed.

DETAILED DESCRIPTION OF THE INVENTION

Dye Donor Web

Figure 1:
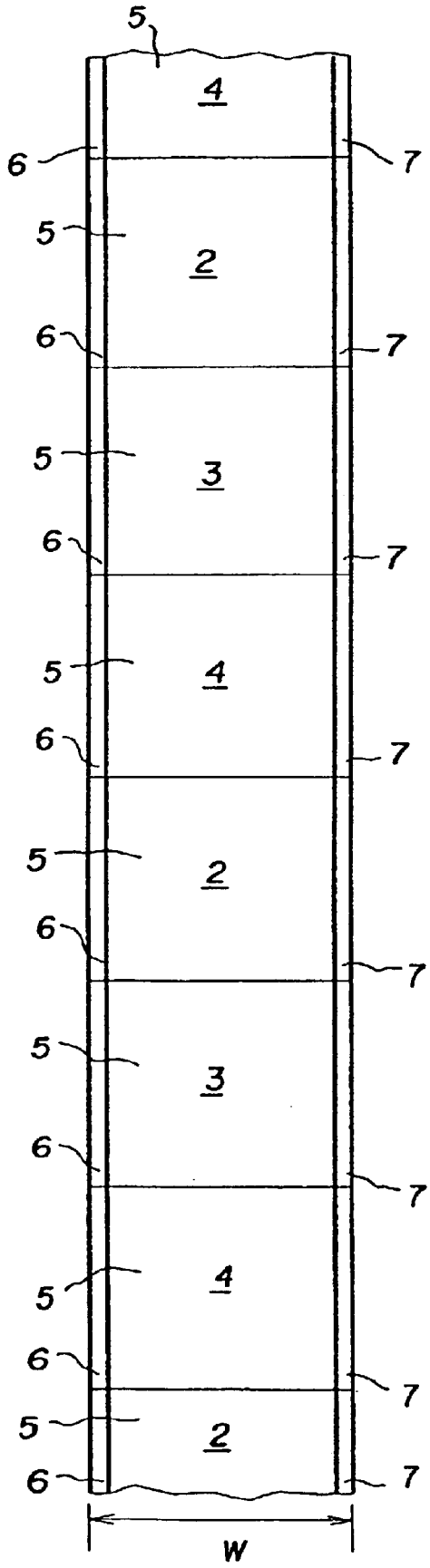
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a dye transfer or thermal printer. The dye donor web 1 is substantially thin and has a repeating series (only two completely shown) of three different rectangular-shaped color sections or patches such as a yellow color section 2, a magenta color section 3 and a cyan color section 4. Also, there may be a transparent laminating section (not shown) immediately after the cyan color section 4.

Figure 10:
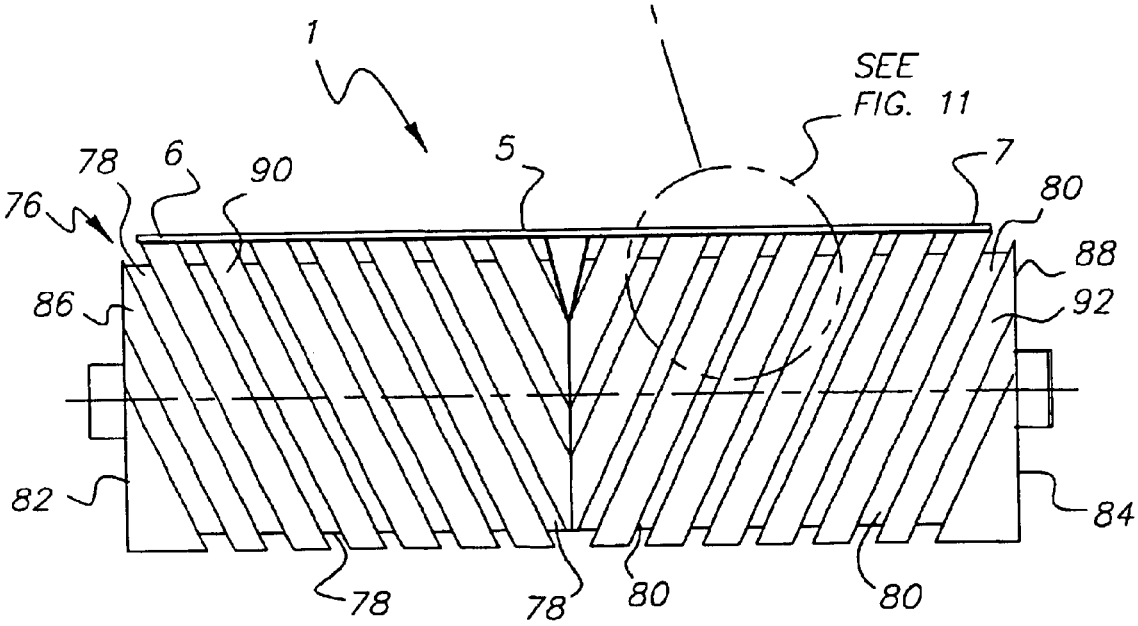
FIG. 10 is an elevation side view of a crease-preventing web roller in the dye transfer printer according to a preferred embodiment of the invention.

Each yellow, magenta or cyan color section 2, 3 and 4 of the dye donor web 1 consists of a yellow, magenta or cyan dye transfer area 5 that is used for printing and a pair of similar-colored opposite longitudinal edge areas 6 and 7 alongside the dye transfer area which are not used for printing. The dye transfer area 5 is about 152 mm wide and the two edge areas 6 and 7 are each about 5.5 mm wide, so that the total web width W is approximately 163 mm. See FIGS. 1 and 10.

Dye Transfer or Thermal Printer

FIGS. 2–6 depict operation of a dye transfer or thermal printer 10 using the dye donor web 1 to effect successive yellow, magenta and cyan dye transfers in superimposed relation onto a known dye receiver sheet 12 such as paper or a transparency.

Initialization

Figure 2:
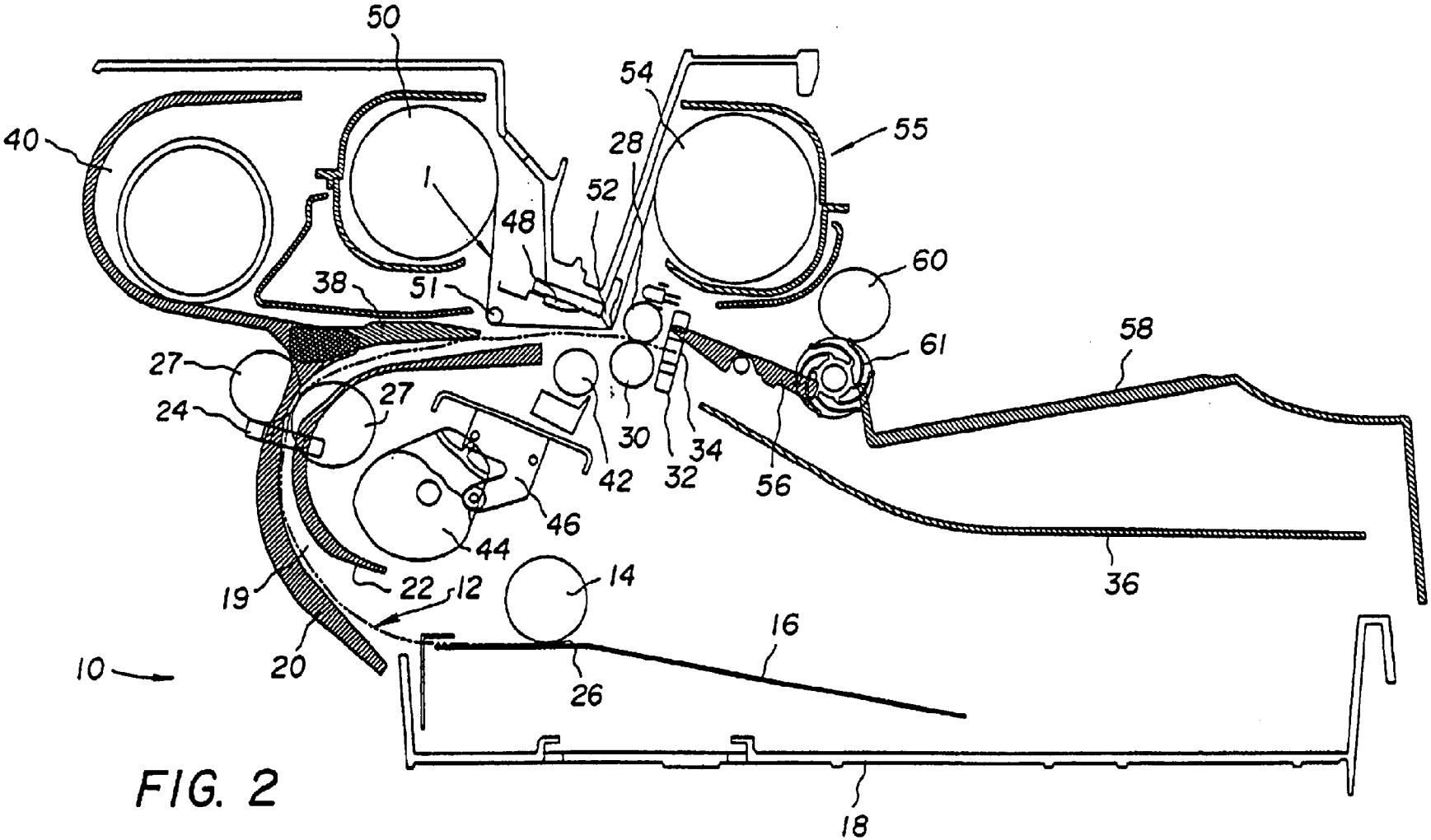
FIG. 2 is an elevation section view, partly in section, of a dye transfer or thermal printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the dye receiver sheet 12, it activates at least one of pair of motorized parallel-axis urge rollers 27, 27 in the channel 19. The activated rollers 27, 27 advance the dye receiver sheet 12 forward (to the right in FIG. 2) through the nip of a motorized capstan roller 28 and a pinch roller 30, positioned beyond the channel 19, and to a leading (front) edge sensor 32.

Figure 3:
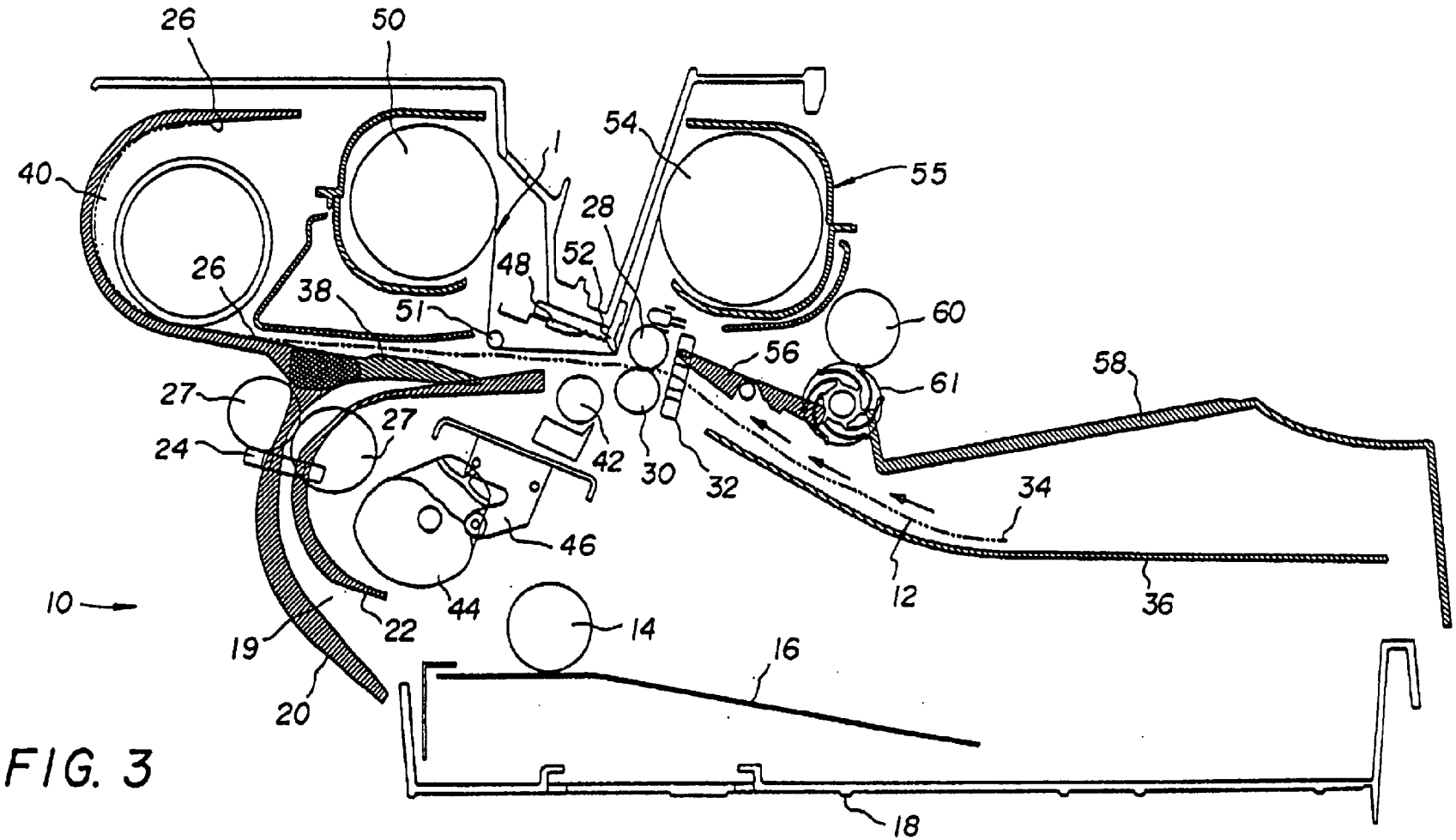
FIGS. 3 and 4 are elevation section views of the dye transfer printer, showing successive dye transfer cycles during the printer operation.

In FIG. 3, the leading edge sensor 32 has sensed a leading or front edge 34 of the dye receiver sheet 12 and activated the motorized capstan roller 28 to cause that roller and the pinch roller 30 to advance the dye receiver sheet forward partially onto an intermediate tray 36. The dye receiver sheet 12 is advanced forward onto the intermediate tray 36 so that the trailing or rear edge 26 of the dye receiver sheet can be moved beyond a hinged exit door 38 that is a longitudinal extension of the curved guide 20. Then, as illustrated, the hinged exit door 38 closes and the capstan and pinch rollers 28 and 30 are reversed to advance the dye receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
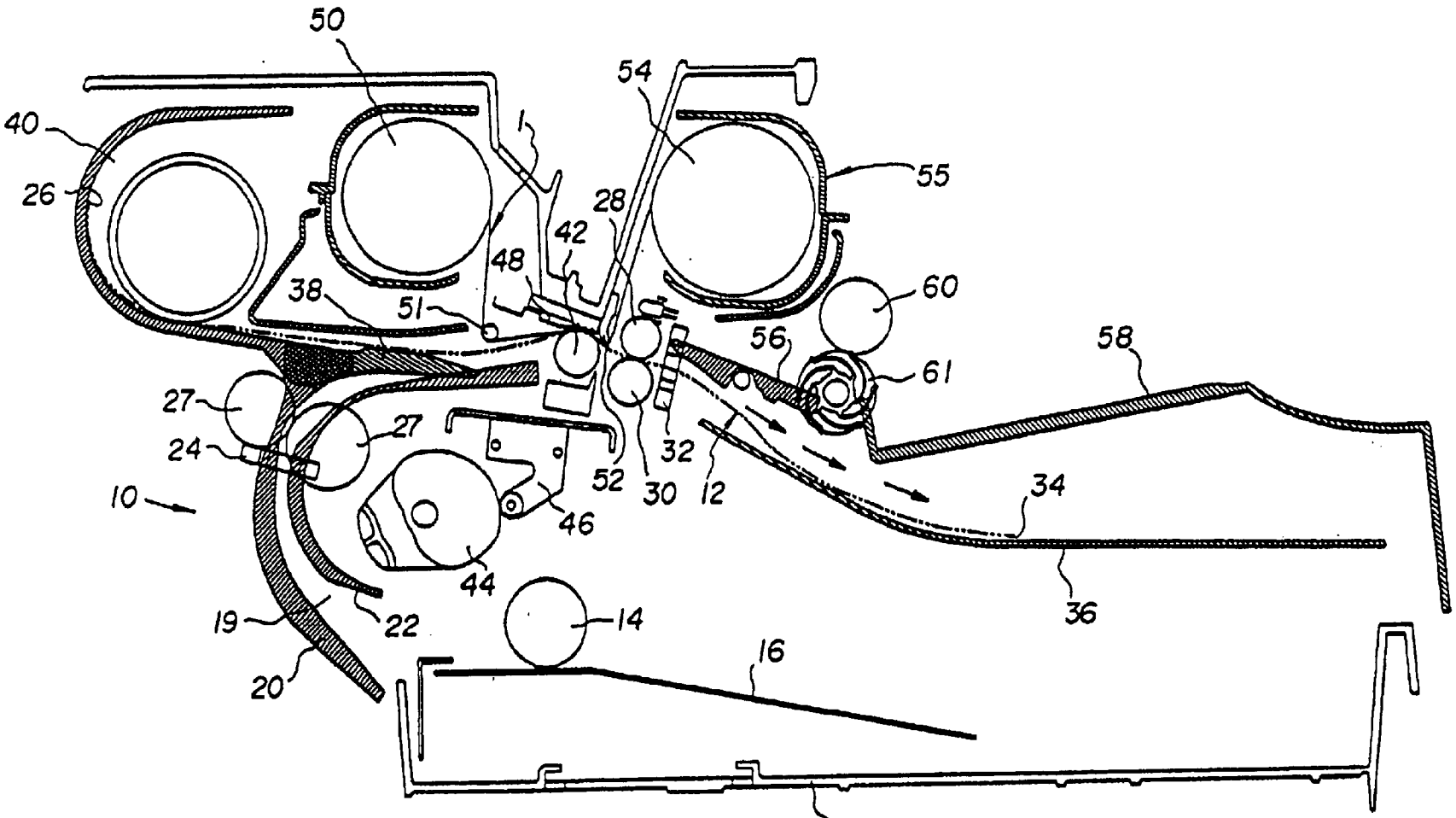

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a first stationary donor web guide bar 51, the print head 48, and a second stationary donor web guide bar or stripper 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable donor web cartridge 55 that is manually loaded into the printer 10.

Figure 7:
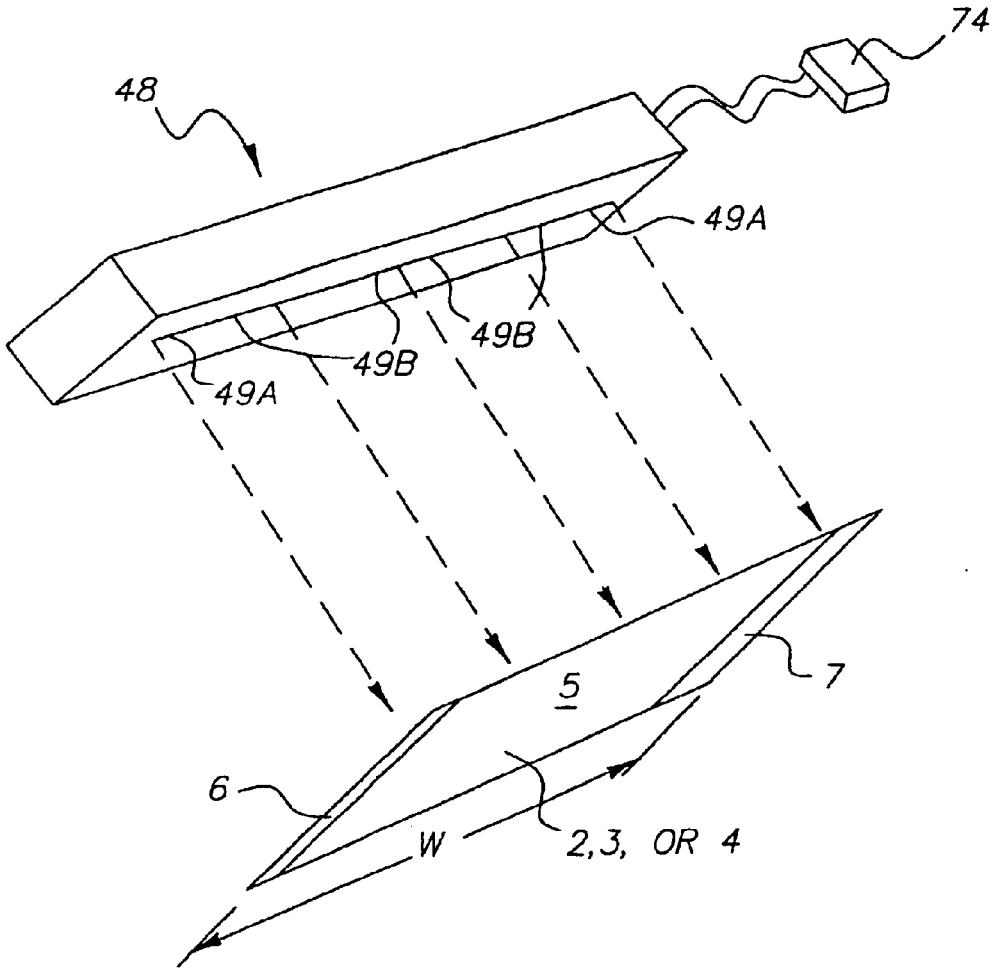
FIG. 7 is a perspective view of a bead of selectively heated resistive elements on a thermal print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a bead of selectively heated, closely spaced, resistive elements 49A, 49A, . . . , 49B, 49B, . . . , 49A, 49A, . . . on the print head 48 that make contact across the entire width W of the yellow color section 2, i.e. across its dye transfer area 5 and the two edge areas 6 and 7 alongside the transfer area. As shown in FIG. 7, the resistive elements 49A make contact with the edge areas 6 and 7 and the resistive elements 49B make contact with the dye transfer area 5. However, only the resistive elements 49B are selectively heated sufficiently to effect the yellow dye transfer from the dye transfer area 5 to the dye receiver sheet 12. The yellow dye transfer is done line-by-line, i.e. row-by-row, widthwise across the dye transfer area 5. The resistive elements 49A are not heated (or only slightly heated) so that there is no yellow dye transfer from the edge areas 6 and 7 to the dye receiver sheet 12.

A known heat activating control 74, preferably including a suitably programmed microcomputer using known programming techniques, is connected individually to the resistive elements 49A, 49A, . . . , 49B, 49B, . . . , 49A, 49A, . . . , to selectively heat those resistive elements 49B that make contact with the dye transfer area 5, and preferably not heat (or only slightly heat) those resistive elements 49A that make contact with the two edge areas 6 and 7 alongside the dye transfer area. See FIG. 7.

Figure 5:
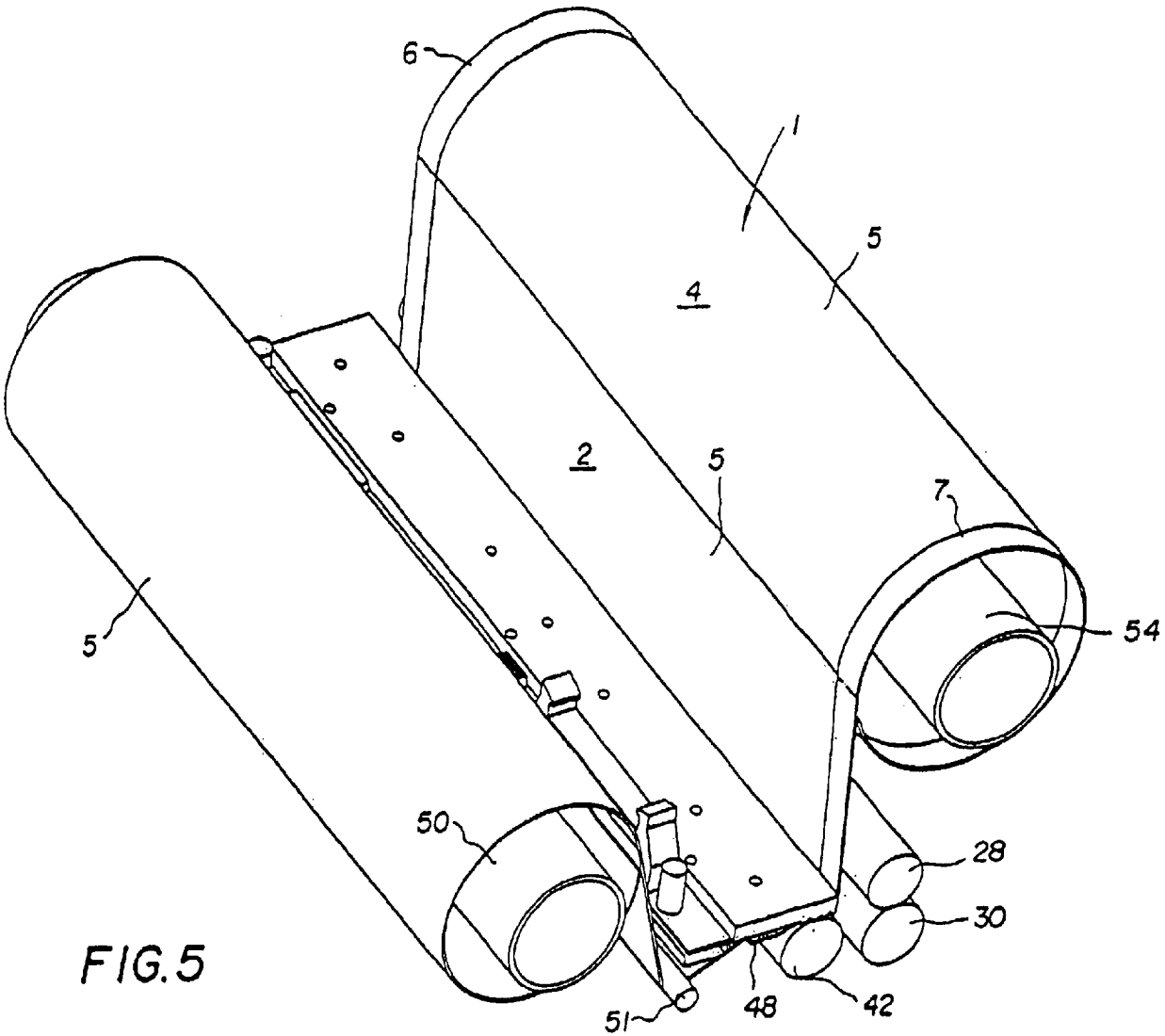
FIG. 5 is perspective view of a printing or dye transfer station in the dye transfer printer.

As the yellow color section 2 of the dye donor web 1 is used for dye transfer line-by-line, it is pulled forward from the print head 48 and over the guide nose 52 in FIGS. 4 and 5. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) cyan color section 3 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing or rear edge 26 first, partially into the rewind chamber 40. See FIG. 3.

Final

Figure 6:
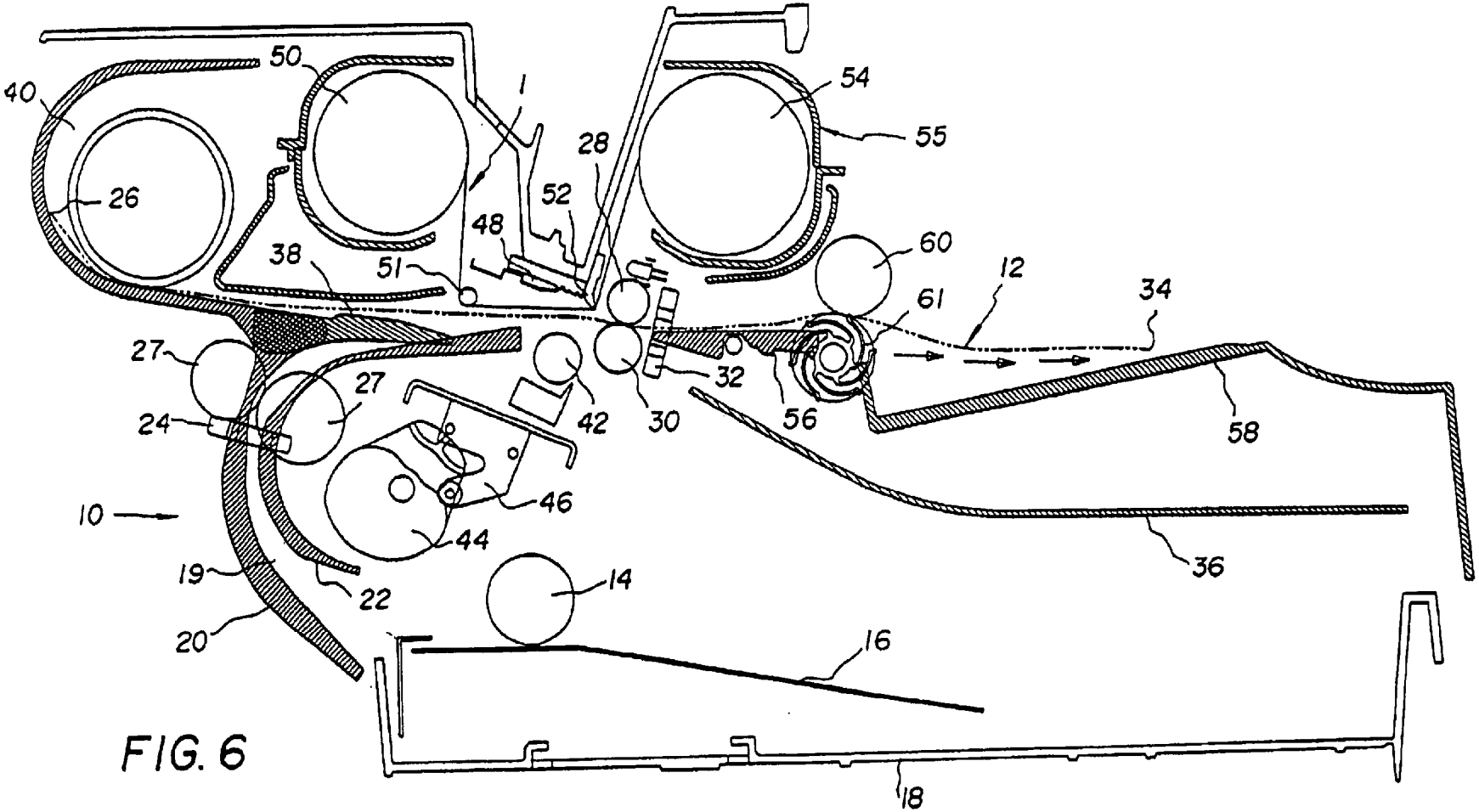
FIG. 6 is an elevation section view of the dye transfer printer, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
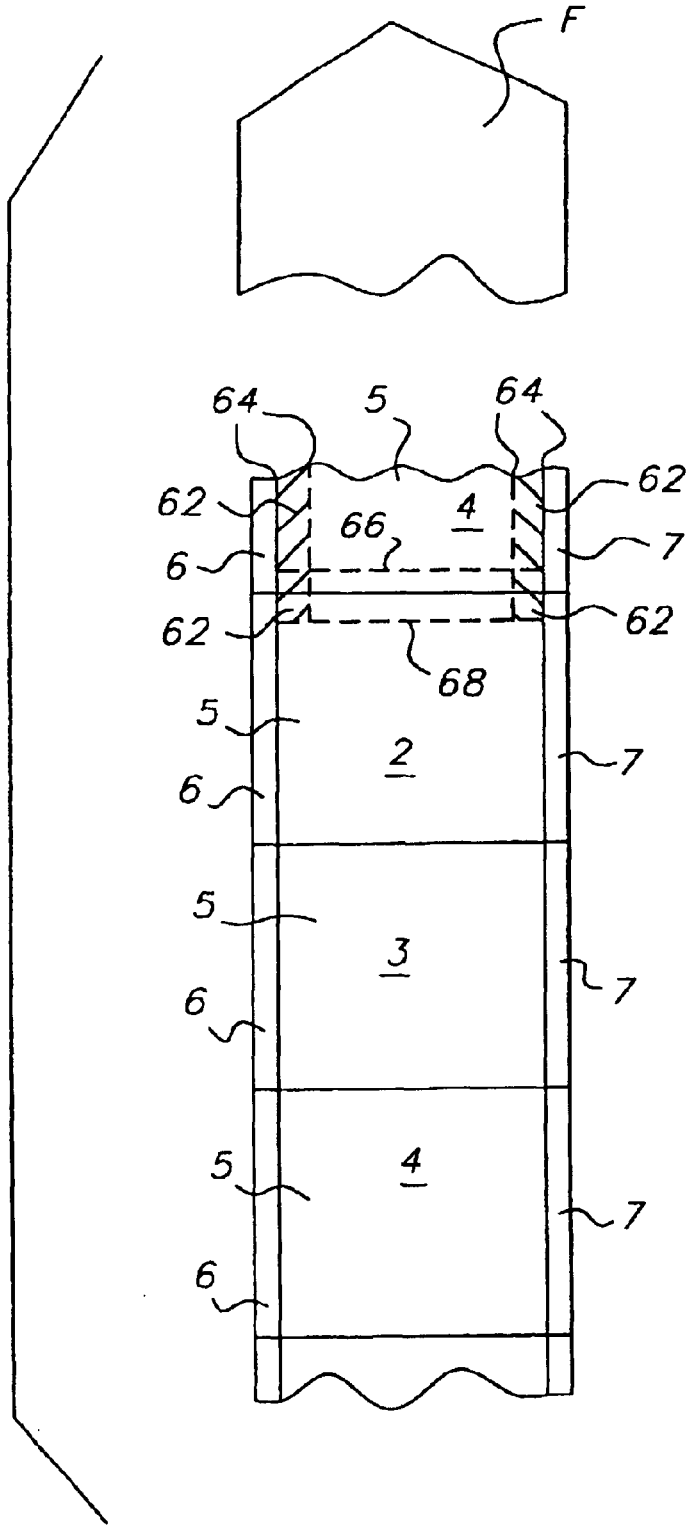
FIG. 8 (PRIOR ART)
FIG. 8 is a plan view of a portion of the dye donor web, showing creases or wrinkles spreading rearward from a trailing or rear end portion of a used dye transfer area into a leading or front end portion of an unused dye transfer area in the next (fresh) color section to be used, as in the prior art.
Figure 11:
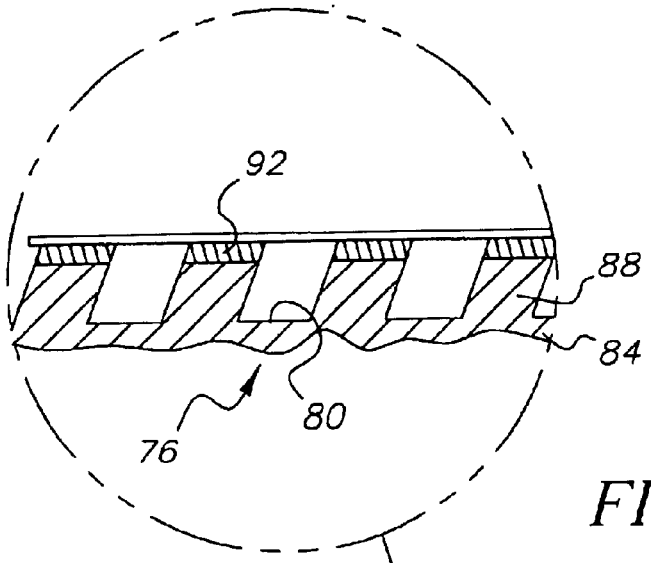
FIG. 11 is an enlarged view of a portion the roller in FIG. 10.

Typically in prior art dye transfer, as each yellow, magenta and cyan color section 2, 3 and 4, including its dye transfer area 5 and the two edge areas 6 and 7 alongside the transfer area, is pulled or drawn forward over the bead of selectively heated resistive elements 49A, 49A, . . . , 49B, 49B, . . . , 49A, 49A, . . . , the color section is subjected to a longitudinal tension imposed substantially by a uniform or substantially uniform forward pulling force F of the motorized donor web take-up spool 54. See FIG. 8. Moreover, since the dye transfer area 5 is heated by the resistive elements 49B, but the two edge areas 6 and 7 alongside the transfer area are not heated by the resistive elements 49A, the dye transfer area is significantly weakened in relation to the two edge areas and therefore becomes more susceptible or vulnerable to being stretched than the edge areas. See FIG. 7. Consequently, the longitudinal tension imposed by the forward pulling force F of the motorized take-up spool 54 will longitudinally stretch the dye transfer area 5 relative to the two edge areas 6 and 7. This stretching causes the dye transfer area 5 to become thinner than the non-stretched edge areas 6 and 7, which in turn causes slanted creases or wrinkles 62 to develop in the dye transfer area, mostly in those regions 64 of the dye transfer area that are close to the two edge areas. See FIG. 8. The slanted creases or wrinkles 62 occur mostly in the regions 64 of the dye transfer area 5 that are close to the two edge areas 6 and 7 because of the sharp, i.e. abrupt, transition between the weakened transfer area and the stronger edge areas, and they are inclined at an approximately 45° acute angle to diagonally extend forward at least within each region.

Figure 9:
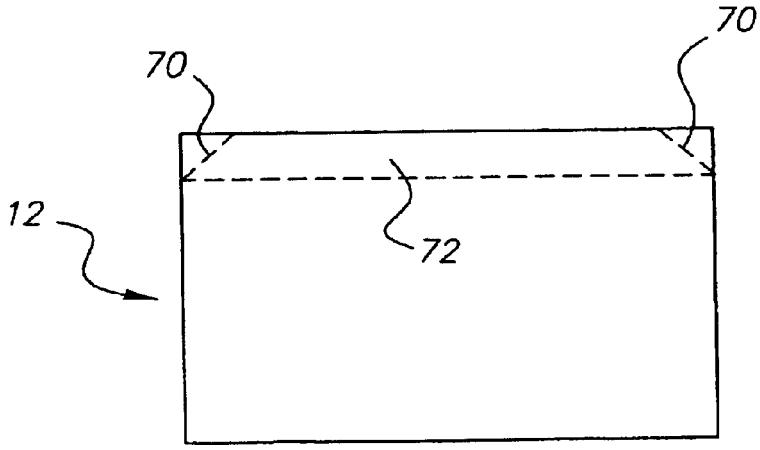
FIG. 9 (PRIOR ART)
FIG. 9 is a plan view of a dye receiver sheet, showing line artifacts printed on a leading or front edge portion of the dye receiver sheet, as in the prior art.

As the dye donor web 1 is pulled by the motorized donor web take-up spool 54 over the bead of selectively heated resistive elements 49A, 49A, . . . , 49B, 49B, . . . , 49A, 49A, . . . , the slanted creases or wrinkles 62 tend to spread rearward from a trailing or rear end portion 66 of a used dye transfer area 5 at least to a leading or front end portion 68 of the next dye transfer area to be used. See FIG. 8. A problem that can result is that the slanted creases or wrinkles 62 in the leading or front end portion 68 of the next dye transfer area 5 to be used will cause undesirable line artifacts 70 to be printed on a leading or front end portion 72 of the dye receiver sheet 12, when the dye transfer occurs at the creases in the leading end portion of the next transfer area to be used. See FIG. 9. The line artifacts 70 printed on the dye receiver sheet 12 are relatively short, but quite visible.

The question presented therefore is how to solve the problem of the slanted creases or wrinkles 62 being created in an unused transfer area 5 so that no line artifacts 70 are printed on the dye receiver sheet 12 during the dye transfer.

Solution

As previously mentioned, before each yellow, magenta or cyan dye transfer onto the dye receiver sheet 12, the platen roller 42 is shifted via the rotated cam 44 and the platen lift 46 to adjacent the print head 48. This causes the dye receiver sheet 12 and an unused (fresh) color section 2, 3 or 4 of the donor web 1 to be locally held together between the platen roller 42 and the print head 48. The platen roller 42, shown in FIGS. 2–6, is cylindrical in shape and therefore has the same diameter from end to end. As such, it is substantially ineffective to prevent the slanted creases 62 from forming in the dye transfer area 5, including in the regions 64 of the dye transfer area that are close to the two edge areas 6 and 7, during the dye transfer. See FIG. 8.

Like the platen roller 42, the stationary donor web guide bar 51, shown in FIGS. 2–6, is cylindrical in shape and therefore has the same diameter from end to end. Thus, it also is substantially ineffective to prevent the slanted creases 62 from forming in the dye transfer area 5, including in the regions 64 of the dye transfer area that are close to the two edge areas 6 and 7, during the dye transfer. See FIG. 8.

According to a preferred embodiment of the invention, shown in FIGS. 10–13, there has been devised a crease-preventing donor web roller 76 that prevents the slanted creases 62 from forming in the dye transfer area 5, including in the regions 64 of the dye transfer area that are close to the two edge areas 6 and 7, during the dye transfer. The crease-preventing web roller 76 can be used in place of the platen roller 42 or the donor web guide bar 51 in FIGS. 2–6. Alternatively, it can be positioned between the platen roller 48 and the donor web guide 51 in FIGS. 2–6.

The crease-preventing roller 76 has opposed helical grooves 78 and 80 that are spiraled inwardly in respective directions from coaxial opposite ends 82 and 84 of the roller to form resilient helical ribs 86 and 88. The helical ribs 86 and 88 meet midway between the roller ends 82 and 84, and they have respective web traction surface layers 90 and 92 that are less resilient than the remainders of the ribs. For example, the web traction surface layers 90 and 92 may be a hard rubber or other suitable elastic substance, and the remainders of the ribs 86 and 88 may be a softer rubber or other suitable elastic substance.

Figure 12:
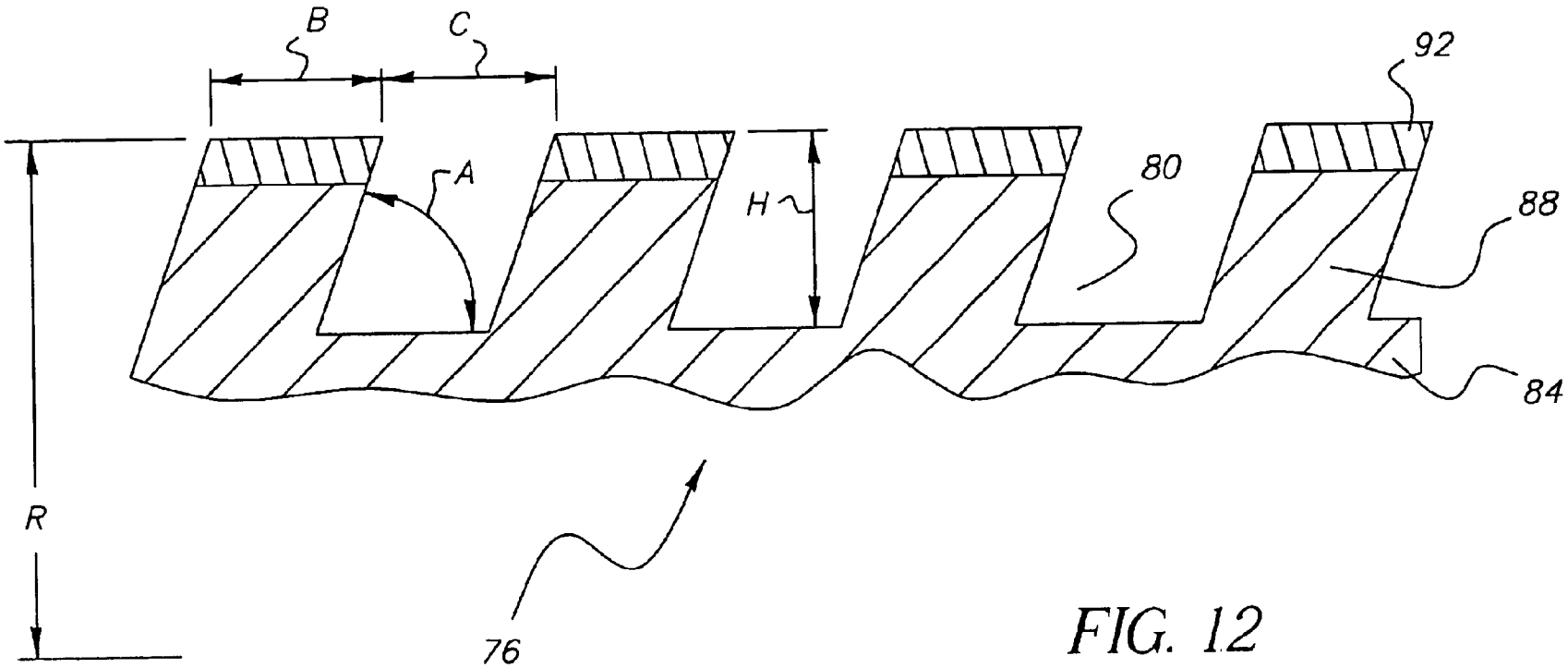
FIG. 12 is a further enlargement of the roller.

As indicated in FIG. 12, the helical ribs 86 and 88 are each inclined an acute angle A towards the roller ends 82 and 84. Preferably, the acute angle A is within the range of 60°–85°. Also, the helical ribs 86 and 88 have the same width B. Preferably, the width B of the helical ribs 86 and 88 divided by the radius R of the crease-preventing roller 76 is within the range of 0.1–0.5, i.e. 10%–50%. Similarly, the helical grooves 78 and 80 have the same width C, and the width of the helical grooves divided by the radius R of the cease-preventing roller 76 preferably is within the range of 0.1–0.5. i.e. 10%–50%. The helical ribs 86 and 88 have the same height H. Preferably, the height H of the helical ribs 86 and 88 divided by the radius R of the crease-preventing roller 76 is within the range of 0.1–0.25, i.e. 10%–25%.

Figure 13:
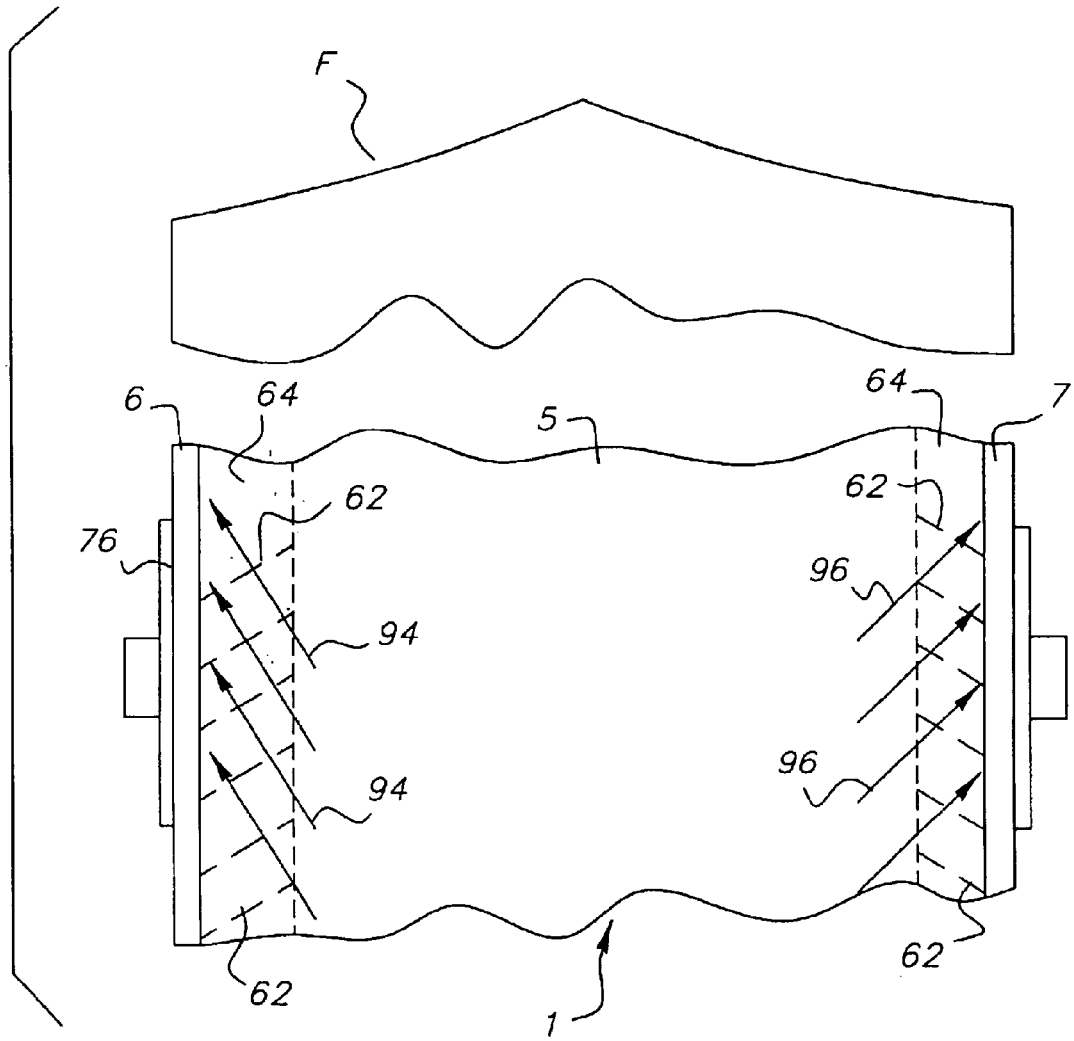
FIG. 13 is a plan view of a portion of the dye donor web, schematically depicting how the roller operates to oppose crease formation.

In operation, the helical ribs 86 and 88 are temporarily deformed or bent towards the roller ends 82 and 84 by the longitudinal tensioning of the dye transfer area 5 and two edge areas 6 and 7 at the print head 48. Such longitudinal tensioning is imposed by the forward pulling force F of the motorized take-up spool 54. As shown in FIG. 13, the helical ribs 86 and 88 when deflected towards the roller ends 82 and 84 cause at least the regions 64 of the dye transfer area 5 in which the slanted creases 62 can form to spread in opposition to crease formation, so that the line artifacts 70, show in FIG. 9, will not be printed on the dye receiver sheet 12 as in the prior art. FIG. 13 illustrates the defected ribs 86 and 88 diagonally urging the dye donor web 1, including the two edge areas 6 and 7 and the adjacent regions 64, 64, in web spreading directions 94 and 96 to oppose (counteract) crease formation.

The invention has been described in detail with particular reference to certain preferred embodiments thereof, but it will be understood that variations and modifications can be effected within the spirit and scope of the invention. For example, the web traction surface layers 90 and 92 on the helical ribs 86 and 88 can be omitted.

PARTS LIST

1. dye donor web
2. cyan color section
3. magenta color section
4. yellow color section
5. dye transfer area
6. longitudinal edge area
7. longitudinal edge area
W. dye donor web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. resistive elements
50. donor web supply spool
51. first stationary (fixed) donor web guide
52. second stationary (fixed) donor web guide
54. donor web take-up spool
55. donor web cartridge
56. diverter
58. exit tray
60. exit roller
61. exit roller
F. forward pulling force
62. slanted creases or wrinkles
64. donor web regions
66. trailing or rear end portion
68. leading or front end portion
70. line artifacts
72. leading or front end portion
74. heat activating control

76. crease-preventing donor web roller
78. helical groove
80. helical groove
82. roller end
84. roller end
86. helical rib
88. helical rib
90. web traction surface layer
92. web traction surface layer
A. rib angle
B. rib width
R. roller radius
C. groove width
H. rib height
94. web spreading direction
96. web spreading direction

What is claimed is:

1. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a donor web take-up that exerts a pulling force on the dye transfer area and two edge areas at said print head which longitudinally tensions the dye transfer area and two edge areas, to tend to cause the dye transfer area to stretch relative to the two edge areas, to possibly form slanted creases extending at least across respective regions of the dye transfer area adjacent the two edge areas; and a crease-preventing web roller having respective helical grooves spiraled inwardly from coaxial opposite ends of said roller to form resilient helical ribs that, when deformed towards said opposite ends because of the longitudinal tensioning of the dye transfer area and two edge areas, cause at least the regions of the dye transfer area in which the slanted creases can form to spread in opposition to crease formation, so that line artifacts will not be printed, the helical ribs having respective web traction surface layers that are less resilient than the remainders of said ribs.

2. A thermal printer as recited in claim 1, wherein said helical ribs are spiraled inwardly from said opposite ends of said roller sufficiently to meet midway between said opposite ends.

3. A thermal printer as recited in claim 1, wherein said helical ribs project from said roller inclined towards said opposite ends of said roller to facilitate their deforming towards said opposite ends because of the longitudinal tensioning of the dye transfer area and two edge areas.

4. A thermal printer as recited in claim 1, wherein said helical ribs are inclined an acute angle within the range of 60°–85°.

5. A thermal printer as recited in claim 4, wherein said helical grooves have the same width, and the width of said helical grooves divided by the radius of said roller is within the range of 0.1–0.5.

6. A thermal printer as recited in claim 1, wherein said helical ribs have the same width, and the width of said helical ribs divided by the radius of said roller is within the range of 0.1–0.5.

7. A thermal printer as recited in claim 6, wherein said helical ribs have the same height, and the height of said helical ribs divided by the radius of said roller is within the range of 0.1–0.25.

8. A thermal printer as recited in claim 1, wherein said roller is a platen roller adapted to locally support the dye receiver and the dye transfer area and two edge areas at said print head so that the dye transfer can occur from the dye transfer area to the dye receiver.

9. A thermal printer as recited in claim 1, wherein said roller is positioned between said print head and a web supply spool for the dye donor web.

10. A thermal printer capable of preventing crease formation in a dye transfer area of a dye donor web that can cause line artifacts to be printed on a dye receiver during a dye transfer from the dye transfer area to the dye receiver, the printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a donor web take-up that exerts a pulling force on the dye transfer area and two edge areas at said print head which longitudinally tensions the dye transfer area and two edge areas, to tend to cause the dye transfer area to stretch relative to the two edge areas, to possibly form slanted creases extending at least across respective regions of the dye transfer area adjacent the two edge areas; and a platen roller residing opposite the thermal print head, the platen roller having respective helical grooves spiraled inwardly from coaxial opposite ends of the platen roller to form resilient helical ribs that, the resilient helical ribs deforming towards the opposite ends during the dye transfer thereby causing the dye donor web at least in the regions of the dye transfer area to spread in opposition to crease formation, so that line artifacts will not be printed.

11. A thermal printer as recited in claim 10 wherein:

the helical ribs are spiraled inwardly from said opposite ends of said roller sufficiently to meet midway between said opposite ends.

12. A thermal printer as recited in claim 10, wherein:

the helical ribs have respective web traction surface layers that are less resilient than the remainders of said ribs.

13. A thermal printer as recited in claim 10 wherein:

the helical ribs are inclined towards the opposite ends of the platen roller to facilitate deformation towards the opposite ends.

14. A thermal printer as recited in claim 13 wherein:

the helical ribs are inclined at an acute angle within the range of 60°–85°.

15. A thermal printer as recited in claim 13 wherein:

the helical grooves have the same width, the ratio of the single width of the helical grooves to the radius of the platen roller being in the range of 0.1–0.5.

16. A thermal printer as recited in claim 13 wherein:

the helical ribs have a uniform height, the ratio of the uniform height of the helical ribs to the radius of the platen roller being in the range of 0.1–0.25.

17. A thermal printer as recited in claim 10 wherein:

the helical ribs have a single width, the ratio of the single width of the helical ribs to the radius of the platen roller being in the range of 0.1–0.5.

18. A thermal printer as recited in claim 10 wherein:

the roller is a platen roller adapted to locally support the dye receiver and the dye transfer area and two edge areas at said print head so that the dye transfer can occur from the dye transfer area to the dye receiver.

19. A method in a thermal printer of preventing crease formation in a dye transfer area of a dye donor web that can cause line artifacts to be printed on a dye receiver during a dye transfer from the dye transfer area to the dye receiver, the method comprising the steps of:

transporting the dye donor and the receiver between a thermal print head and a platen roller, the platen roller having respective helical grooves spiraled inwardly from coaxial opposite ends of the platen roller to form resilient helical ribs;

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

longitudinally tensioning the dye transfer area and two edge areas at the print head, to tend to cause the dye transfer area to stretch relative to the two edge areas causing thereby deforming the resilient helical ribs towards the opposite ends during the dye transfer and causing the dye donor web at least in the regions of the dye transfer area to spread in opposition to crease formation, so that line artifacts will not be printed.

* * * * *